US011105576B2

(12) United States Patent
Mikhailovich et al.

(10) Patent No.: US 11,105,576 B2
(45) Date of Patent: Aug. 31, 2021

(54) MACHINE GUN INFANTRY "KT-7.62"

(71) Applicant: Willow Associates, LLC, Tampa, FL (US)

(72) Inventors: Kravchenko Iurii Mikhailovich, Brovary (UA); Berezin Igor Veleriyovych, Kyiv (UA)

( * ) Notice: Subject to any disclaimer, the term of this patent is extended or adjusted under 35 U.S.C. 154(b) by 0 days.

(21) Appl. No.: 15/995,530

(22) Filed: Jun. 1, 2018

(65) Prior Publication Data

US 2020/0116449 A1 Apr. 16, 2020

(30) Foreign Application Priority Data

Jun. 1, 2017 (UA) ..... 118320

(51) Int. Cl.

| | |
|---|---|
| ***F41A 21/20*** | (2006.01) |
| ***F41A 21/18*** | (2006.01) |
| ***F41A 3/66*** | (2006.01) |
| ***F41A 7/02*** | (2006.01) |
| ***F41A 21/34*** | (2006.01) |

(52) U.S. Cl.

CPC ..... *F41A 21/20* (2013.01); *F41A 3/66* (2013.01); *F41A 7/02* (2013.01); *F41A 21/18* (2013.01); *F41A 21/34* (2013.01)

(58) Field of Classification Search

CPC .... F41A 21/20; F41A 3/66; F41A 7/02; F41A 21/18; F41A 21/34

USPC ..... 89/9, 16, 14.7

See application file for complete search history.

(56) References Cited

U.S. PATENT DOCUMENTS

| | | | | |
|---|---|---|---|---|
| 2,876,095 A * | 3/1959 | Dickerson | F41A 21/20 420/83 |
| 4,756,677 A * | 7/1988 | Hribernik | B22F 7/062 419/28 |
| 5,458,703 A * | 10/1995 | Nakai | C21D 1/18 148/503 |
| 2010/0003162 A1* | 1/2010 | Arrenbrecht | C21D 9/12 420/109 |
| 2018/0142332 A1* | 5/2018 | Bellus | C22C 38/24 |
| 2019/0145726 A1* | 5/2019 | Theriault | F41A 21/04 89/14.7 |

OTHER PUBLICATIONS

Wikipedia Article on PK Machine Gun (Year: 0000).*
Technical Drawings of KM 7.62 Machine Gun (Year: 0000).*
Mayak Product listing for KM 7.62 Machine Gun (Year: 0000).*

* cited by examiner

*Primary Examiner* — Samir Abdosh

(57) ABSTRACT

A machine gun has a barrel, a receiver assembly comprising a cover, a receiver base and a butt; lock frame comprising an extractor and a gas piston; bolt, return mainspring with guiding bar, gas piston tube, flash absorber, trigger mechanism, gunsight, butt sighting appliances, trigger pull and loading case. A barrel is made of a preform produced of steel doped with chromium, molybdenum and vanadium or chromium, nickel, and molybdenum, or chromium, molybdenum, vanadium and nickel. The barrel is coated inside and steel comprises the additional chemical elements.

2 Claims, 10 Drawing Sheets

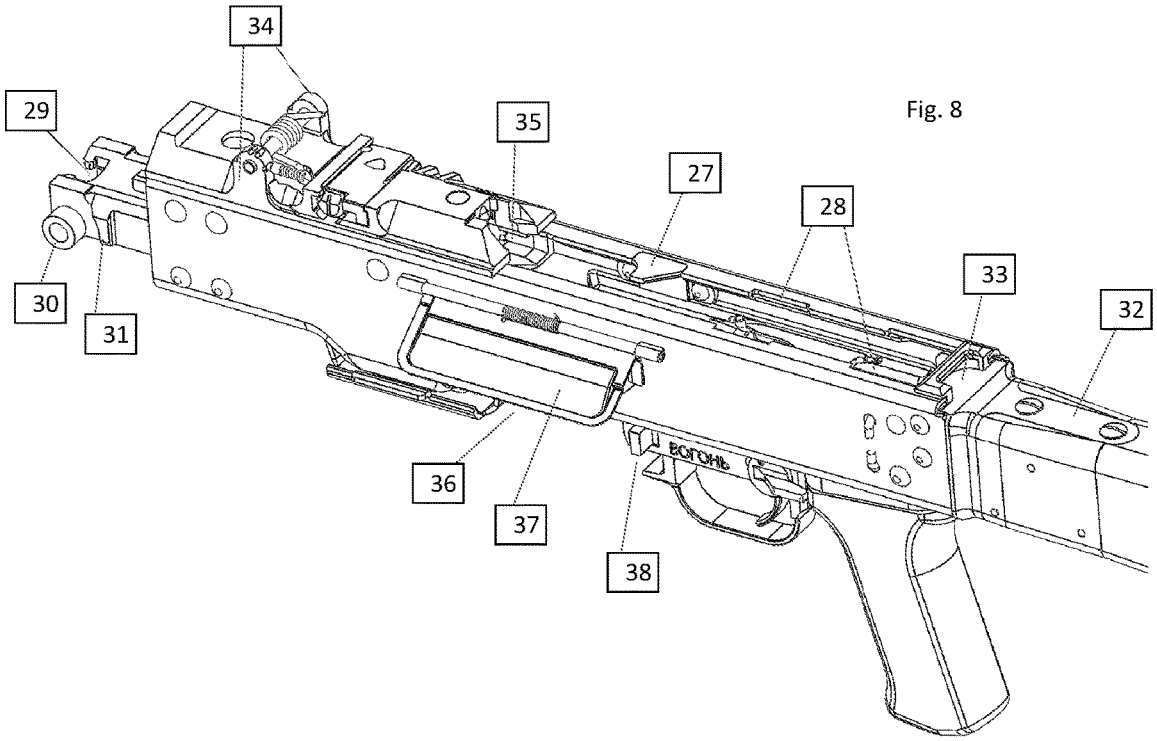
Fig. 8
Fig. 9
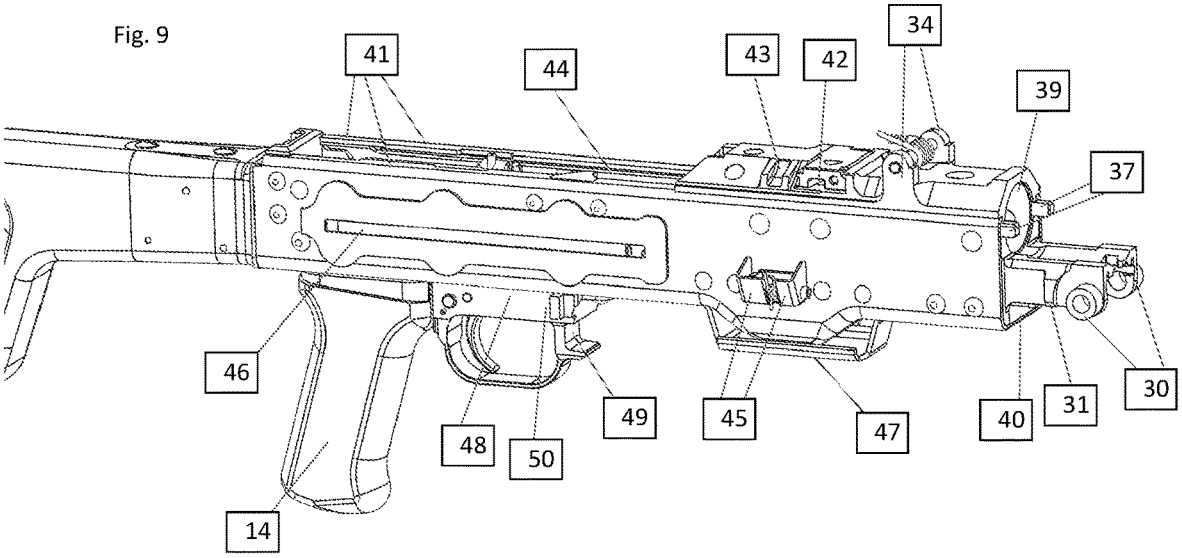
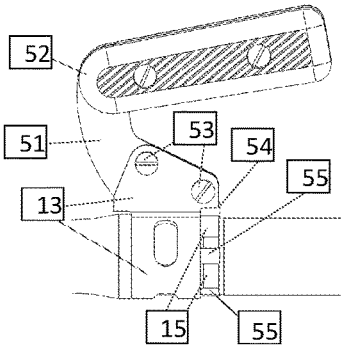
Fig. 10

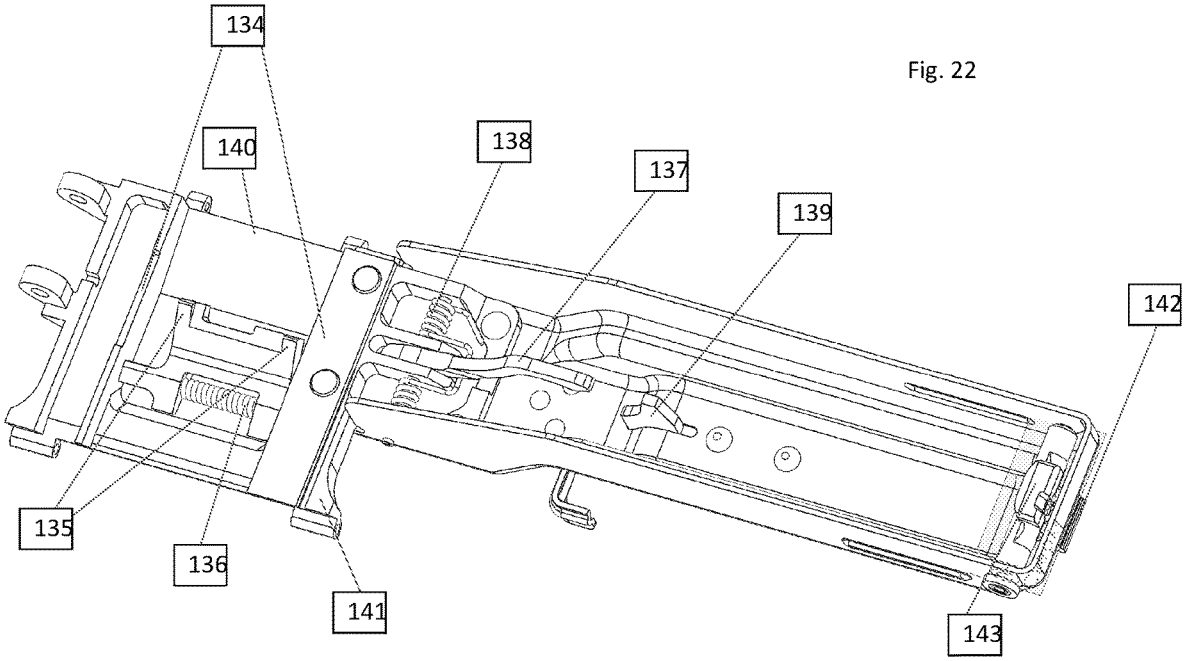
Fig. 22
Fig. 23
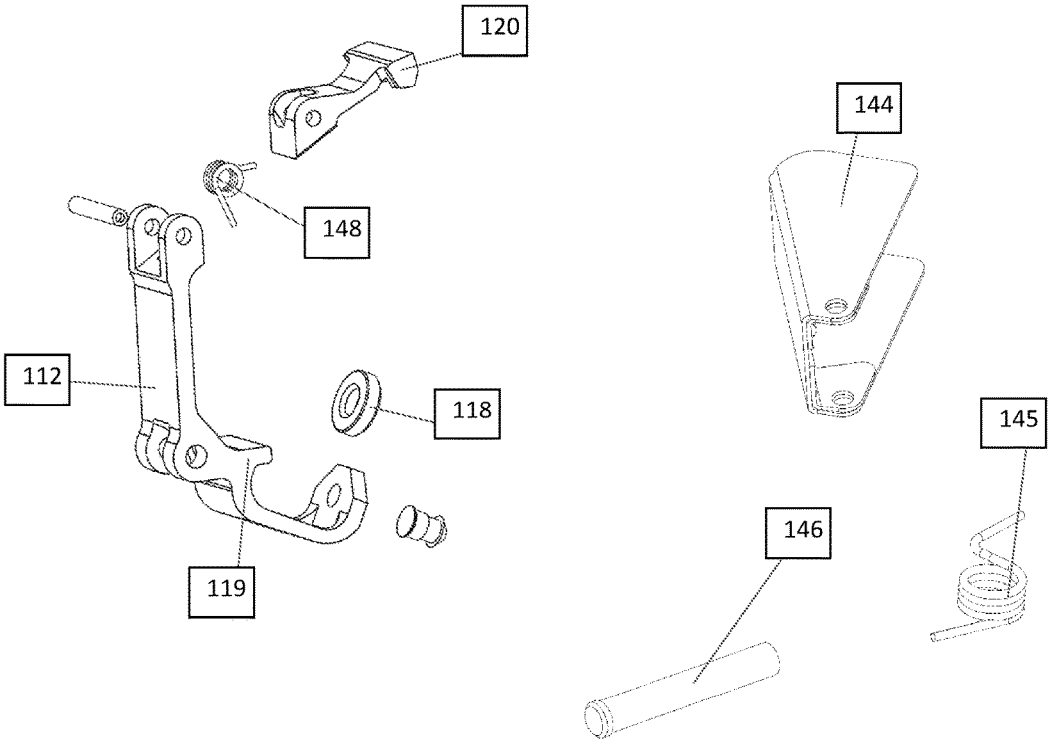

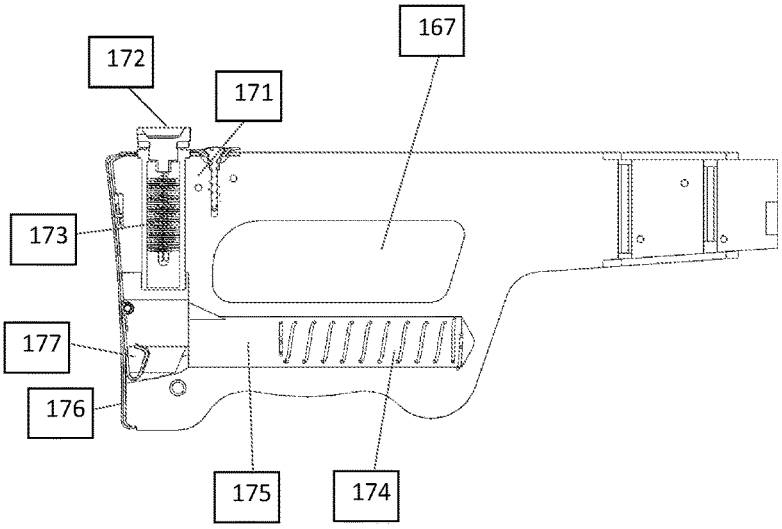
Fig. 27
Fig. 28
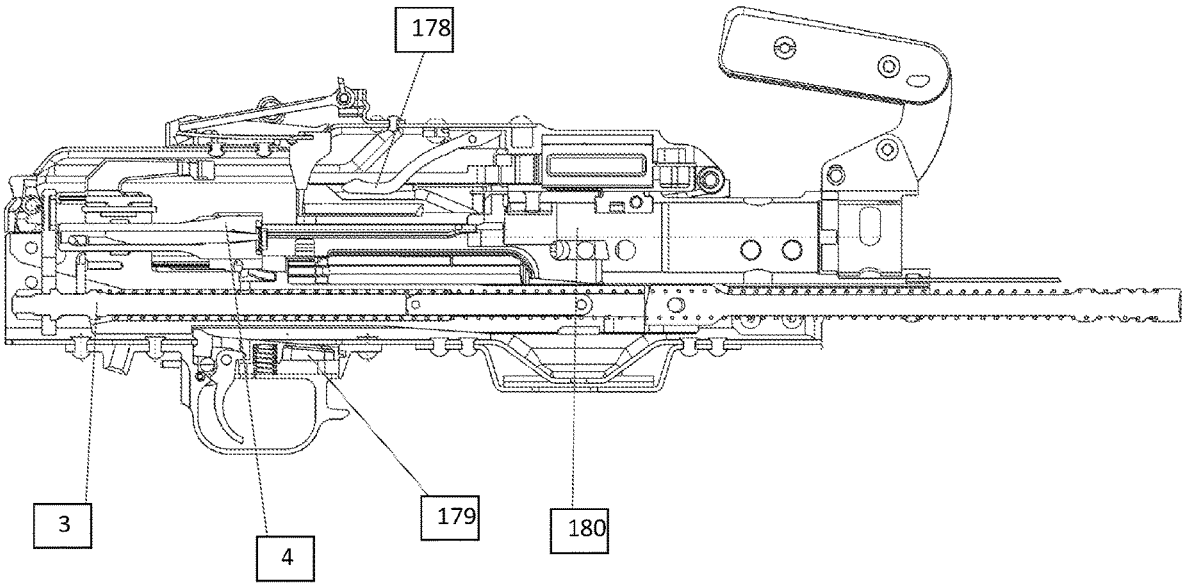

MACHINE GUN INFANTRY "KT-7.62"

BACKGROUND OF THE INVENTION

Field of the Invention

The utility model relates to the weapon field, more particularly to the small arms, in particular to the machine guns, specifically to the infantry machine guns, and to the infantry machine gun "KT-7.62".

The closest prior art for the present utility model is machine gun KM-7.62 developed by PJSC Factory "Mayak". (http://mavak.com.ua/uk/catalogue/small-arms/km-7-62 is attached). Machine gun automation operates based on the explosive gas withdrawal from a barrel bore and long gas piston stroke. The vent mechanism is located below the barrel. The barrel bore is closed by means of a revolving breech-block. The barrel of this machine gun is made of steel grade 30ХРГМФА under the government standard ДСТ В5150-89. The technical solution described is considered as the closest prior art in view of the substantial features.

However, the said machine gun has a number of drawbacks. In particular, the drawback is that the barrel preform made of steel grade 30XPFM(DA under ДСТ В5150-89 allows less than 15000 shots to be fired and, consequently, a performance of this article is very low. 15000 shots are very low number and, therefore, there is a need to develop a machine gun that will provide more number of shots.

The object of the present utility model is to improve a machine gun and develop such a machine gun that will fire more number of shots and, consequently, has more barrel durability that will allow to increase an article performance.

The said problem is solved by the machine gun having a barrel, a receiver assembly comprising a cover, a receiver base and a butt; lock frame comprising an extractor and a gas piston, bolt, return mainspring with guiding bar, gas piston tube, flash absorber, trigger mechanism, gunsight, butt sighting appliances, trigger pull and loading case; according to the utility model, a barrel is made of steel doped with chromium, molybdenum and vanadium or chromium, nickel and molybdenum, or chromium, molybdenum, vanadium and nickel, the said barrel being coated inside and steel comprising the additional chemical elements.

The present substantial features solve the said problem and allow the infantry machine gun to fire more number of shots that is 30000. As a consequence, a barrel durability of such machine gun is increased in two times and a machine gun performance is two times greater compared to the closest prior art.

The technical peculiarity of the present utility model is that the gun barrel is made of steel doped with chromium, molybdenum and vanadium or chromium, nickel and molybdenum, or chromium, molybdenum, vanadium and nickel.

A multipurpose use of steels of a certain grade for manufacturing a barrel preform and a technological processing of a barrel made of these preforms until a coating is formed inside a barrel enables to produce the infantry machine gun which number of shots is 30000 that is due to that the above steel preforms used for producing a barrel are processed under the so-called technique Tenifer QPQ.

Thus, for the first time, the new technical solution relating to a development of the new infantry machine gun firing 30000 shots and having increased barrel durability is implemented for technically effective functioning of the infantry machine gun in accordance with the present utility model.

According to the proposed technical solution, a number of shots of the infantry machine gun is 30000. The technical rate of fire is 650 shots per minute. The effective rate of fire is 250 shots per minute. The gun range is from 1600 m to 2000 m, the most effective fire from the machine gun ranges to 1000 m, the maximal bullet flight range is 3800 m. The bullet flight range for which a damage effect is kept is 3800 m. The barrel is air-cooled. It is allowed to continuously firing up to 500 shots after which the heated barrel is to be cooled down or replaced by the new one(spare). Starting bullet flight speed is 825 m/s. When firing, the cartridges are loaded into the receiver from the metal machine gun belt in pieces put in the box. Belt capacity is 250 cartridges. The weight of the machine gun KT-7.62 is 8.8 kg. The barrel weight is 2.2 kg. Cartridge box weight equipped with a belt for 250 cartridges is 8.4 kg. The machine gun is operated at the temperature of from −50° C. to +50° C. and at the air moisture of 98% at the temperature of 40° C.

According to the proposed technical solution, the composition of steel doped with chromium, nickel and molybdenum used is provided in Table 1.

TABLE 1

| | C carbon | Si silicon | Mn manganese | Cr chromium | Mo molybdenum | Ni nickel |
|---|---|---|---|---|---|---|
| Chemical composition: (%) | 0.34 | 0.25 | 0.50 | 1.50 | 0.25 | 1.55 |

According to the proposed technical solution, a composition of steel doped with chromium, molybdenum and vanadium used is provided in Table 2.

TABLE 2

| | C carbon | Si silicon | Mn manganese | Cr chromium | Mo molybdenum | S sulphur | V vanadium |
|---|---|---|---|---|---|---|---|
| Chemical composition: (%) | 0.41 to 0.49 | 0.20 to 0.35 | 0.60 to 1.00 | 0.8 to .15 | 0.15 to 0.4 | 0.04 to 0.09 | 0.2 to 0.3 |

According to the proposed technical solution, a composition of steel doped with chromium, molybdenum and vanadium used is provided in Table 3.

TABLE 3

| | C | Si | Mn | Ni | Cr | Cu | Mo | S | P | Al | Sn | V |
|---|---|---|---|---|---|---|---|---|---|---|---|---|
| Chemical composition: (%) | 0.4 | 0.21 | 0.88 | 0.19 | 0.96 | 0.32 | 0.57 | 0.016 | 0.13 | 0.02 | 0.013 | 0.217 |

Steel doped with chromium, nickel and molybdenum (steel grade 34CrNiMo6) or steel doped with chromium, molybdenum and vanadium (steel under standard MIL-B-11595E), or steel doped with chromium, molybdenum, and vanadium under standard or steel doped with chromium, molybdenum, vanadium and nickel (steel grade 41v40) is preferably used.

One of the preferred examples of embodiment of the present utility model is further provided. The said example is provided for understanding an essence and properties of the described technical solution and it is not intended to limit the utility model to any of its embodiments. A person skilled in the art is to understand all supplements and modifications which do not go behind the scope of the said example.

The steel preforms for producing a barrel are subjected to processing under so-called technique Tenifer QPQ described below for creating a special coating.

The barrel preforms are preliminary heated, carbonized for 6 hours in two steps, sandblasted, oxidized until $Fe3O_4$ is formed on the surface of the material and washed.

More specifically, steels used from which a barrel is produced are thermally and chemically treated: they are treated in the heating stove, they are then sequentially treated in the carbonitriding bath, in the oxidizing bath and in the washing bath. The material is preliminary heated to the temperature of 350° C. for 45 minutes in the heating stove in the environment of warm air. A carbonitriding is further carried out in the carbonitriding bath in the environment of melted salt. A carbonitriding process is started immediately after submersion of the batch of the articles in the melt. A solid compound layer formation can be observed in the several minutes.

A batch of articles is sequentially kept in the first bath for 4 hours at the temperature of 580° C. and in the second bath for 2 additional hours at the temperature of 580° C. The material is sandblasted in the sandblast container SBC 420, sand being used having a granule size of 90 microns. The articles which have been carbonitrided in the carbonitriding bath are cooled in the oxidizing bath in the environment of melted salt. Bath temperature ranges from 420 to 430° C. Subsequent cooling of the said articles in the oxidizing bath substantially increases corrosion resistance thereof on its surface due to formation of magnetic iron oxide ($Fe_3O_4$) on the surface of the article being treated. The surface of the articles becomes black after this procedure. The articles are submerged in the washing bath in the environment of water for cleaning them from the salt residues which remain on the surface of the material from the previous bath. Temperature is about 13° C. According to this technique, the article possess an increased hardness and an increased corrosion resistance.

The suggested technical solution comprises a barrel (FIG. 2, ref. 1), a receiver assembly comprising a cover, a receiver base and a butt (FIG. 2, ref 2); lock frame comprising an extractor and a gas piston (FIG. 2, ref 3), bolt (FIG. 2, ref 4), return mainspring (FIG. 2, ref 6) with guiding bar (FIG. 2, ref. 5), gas piston tube (FIG. 2, ref 7), flash absorber (FIG. 2, ref 8), trigger mechanism, gunsight, butt sighting appliances, trigger pull and loading case.

The barrel of the proposed technical solution is made of a steel preform produced of steel doped with chromium, molybdenum and vanadium or chromium, nickel and molybdenum, or chromium, molybdenum, vanadium and nickel.

The proposed technical solution is shown in more details on the Figures.

BRIEF DESCRIPTION OF THE DRAWINGS

The Figures show: FIG. 8 depicts the receiver assembly, FIG. 9 depicts the receiver assembly, FIG. 10 depicts the machine gun handle, FIG. 22 depicts receiver cover, FIG. 23 shows the follower, FIG. 27 shows the butt, FIG. 28 shows loaded machine gun (positions of the parts and of mechanisms before shooting).

The Drawings formally depict:

Figure 1:
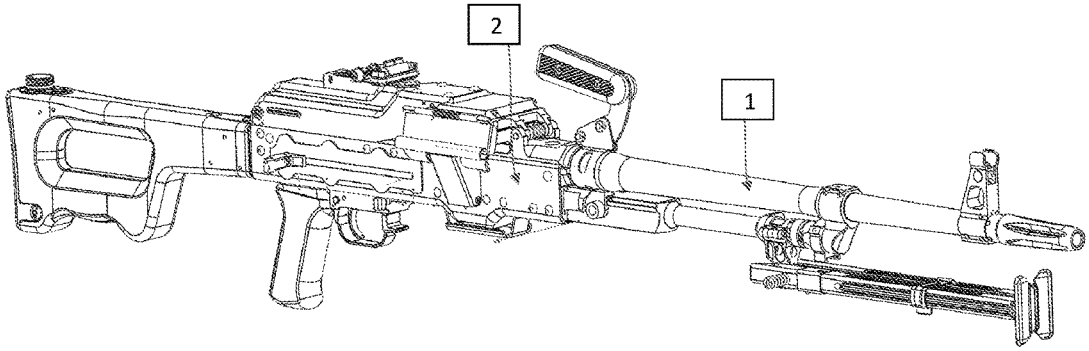
FIG. 1 is a general view of the article.

1—barrel; 2—receiver assembly comprising cover and receiver base; 3—lock frame with an extractor and gas piston; 4—bolt; 5—guiding bar; 6—return mainspring; 7—gas piston tube; 8—flash absorber, 9—thread; 10—front sight base; 11—gas chamber; 12—gas adjuster; 13—handle charger; 14—handle; 15—projection; 16—transverse cut-outs for fixing the barrel; 17, 18—cut-outs for receiving the lock frame projection and receiver assembly projection; 19—cut-outs for engaging the extractor; 20—annular projection, 21—grooves for a clamp; 22—flash absorber slits; 23—pins for the front sight base; 24—clamp for the front sight base; 25—front sight slide; 26—front-sight cover, 27—repulsing projection of the receiver assembly; 28—cut-outs for receiving the lock frame and bolt; 29—cut out for receiving the spring lock for receiver assembly; 30—receiver assembly trunnion pins; 31—receiver assembly projections; 32—receiver assembly tang; 33—transverse housing with a depression in the receiver assembly; 34—tab for fastening receiver assembly cover; 35—receiver assembly longitudinal cut-out; 36—window for ejecting cases (cartridges) in the receiver assembly; 37—breech cover; 38—cut-out and projection for fastening the machine gun on the carriage, 39—conduit for receiving a breech end of the barrel; 40—conduit for gas piston tube; 41—flaps; 42—transverse housing for barrel latch; 43—slanted transverse cut-out; 44—longitudinal window; 45—tabs for fastening the follower; 46—transverse housing for reloading handle; 47—bracket for fastening a box containing a cartridge feed belt; 48—trigger container; 49, 50—cut-out and projection for fastening the machine gun on the carriage; 51—handle base; 52—cheeks; 53—screws; 54—slide; 55—cut-outs for fixing the handle; 56—barrel latch base; 57—screw for barrel latch, 58—barrel latch base pin; 59—stud for the screw for the barrel latch; 60—groove for engaging the barrel; 61—stepped cut-out for receiving a pawl; 62—threaded conduit for the screw, 63—rod for reloading handle; 64—reloading handle arm; 65—axle for reloading handle arm; 66—reloading handle arm spring; 67—driving projection of the reloading handle; 68—leg for fixing reloading handle arm; 69—reloading handle arm hook, 70—bevelled ribs for breech cover pusher; 71—breech cover fold; 72—breech cover loop, 73—cut-out for receiving reloading handle rod; 74—guiding projections; 75—spring lock; 76—orifices for escaping explosive gases; 77—groove for mounting a gas fitting clutch, 78—conduit for return mainspring; 79—cut for passing by cases being ejected; 80—slanted edge for interacting with the follower roller; 81—projection for interacting with breech cover pusher; 82—longitudinal grooves, 83—figured cut-out in the lock frame with gas piston; 84—slanted edge in the lock frame with gas piston for interacting with the follower projection; 85—groove in the lock frame with gas piston for interacting with the follower projection; 86—step made in the lock frame with gas piston for the reloading handle projection; 87—housing in the lock frame with gas piston for connecting to the gas piston; 88—leg; 89—hooked extractor in the lock frame with gas piston; 90—through conduit made in the lock frame with gas piston for mounting the bolt; 91—longitudinal grooves made in the lock frame with gas piston; 92—bulge for connecting to the lock frame; 93—annular grooves in the lock frame with gas piston; 94—driving shoulder in the lock frame with gas piston, 95—bolt skeleton; 96—bolt firing hammer; 97—bolt ejector; 98—bolt ejector spring; 99—bolt ejector axle; 100—bolt axle stud; 101—cylindrical bolt cut-out for a case bottom; 102—cylindrical bolt cut-out for ejector with spring; 103—service bolt projections; 104—bolt projection (feed piece) for ramming a cartridge into the cartridge chamber; 105—driving bolt projection; 106—longitudinal bolt groove for receiving the repulsing projection; 107—bolt opening for the ejector axle; 108—boltway for receiving firing hammer, 109—firing hammer projection for the bolt, 110, 111—back and front parts of the guiding bar; 112—lock frame arrester; 113—annular projection; 114—projection for connecting to the receiver assembly back wall, 115—receiver base; 116—receiver assembly cover; 117—follower; 118—follower roller; 119—follower projection; 120—pawl; 121—upper levers; 122, 123—shields; 124—follower rod, 125—guiding receiver base projections; 126—arresting receiver base projections; 127—transverse receiver base window; 128—receiver base figured cut-outs; 129—receiver base projections for abutting by a case flange; 130—receiver base cut-out for a case flange; 131—inclined receiver base projection for guiding a cartridge; 132—receiver base tabs; 133—receiver base retainer, 134—guiding receiver assembly cover projections; 135—upper receiver assembly cover levers; 136—upper levers spring of the receiver assembly cover; 137—receiver assembly cover actuator; 138—receiver assembly cover actuator spring; 139—receiver assembly actuating comb; 140, 141—receiver assembly cover shields; 142—cover lock; 143—receiver assembly cover spring lock, 144—follower rod; 145—follower rod spring, 146—follower and rod axle; 147—follower roller; 148—follower pawl spring, 149—cartridge feed belt chains; 150—connecting springs of the cartridge feed belt; 151—cartridge feed belt tip; 152—connecting chain of the cartridge feed belt; 153—cartridge feed belt annular chain; 154—firing lever; 155—trigger pull; 156—firing lever spring; 157—trigger lock; 158—trigger hammer catch; 159—trigger rounded bevel; 160—trigger pull branch; 161—projection for limiting the trigger pull rotation; 162—trigger mechanism hook for interacting with firing lever; 163—thumb piece; 164—narrow trigger mechanism cut-out; 165—wide trigger mechanism, cut-out; 166—trigger mechanism projection for fastening safety-lock, 167—through butt cut-out; 168—metal butt plate; 169—housing cover for butt kit; 170—butt shoulder piece, 171—butt lubricator; 172—butt lubricator cover; 173—brush for a butt; 174—butt spring; 175—kit for a butt; 176—metal plate for a butt; 177—housing cover for a butt kit; 178—actuator; 179—hammer catch; 180—cartridge chamber.

DETAILED DESCRIPTION

Figure 2:
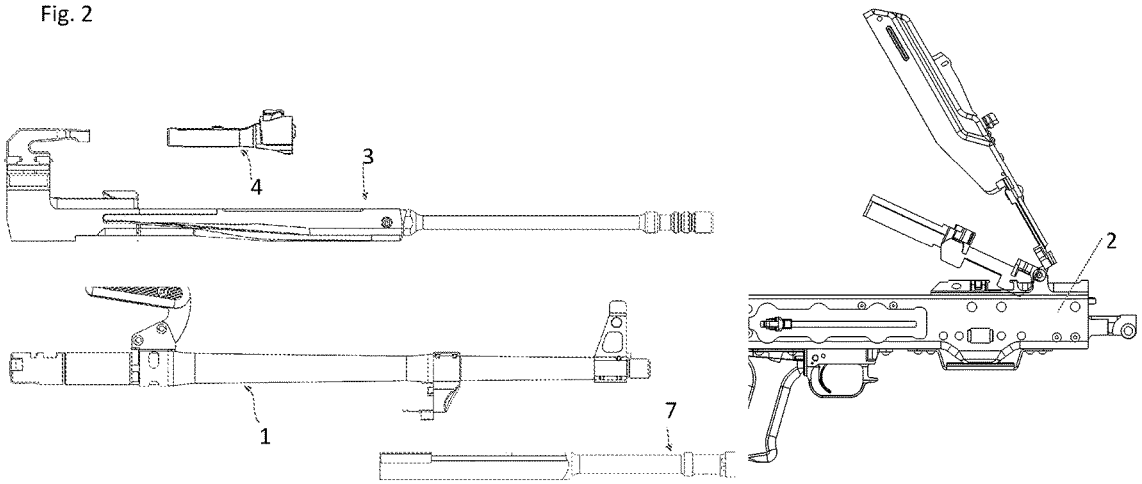
FIG. 2 depicts the base parts and mechanisms of the machine gun.
Figure 3:
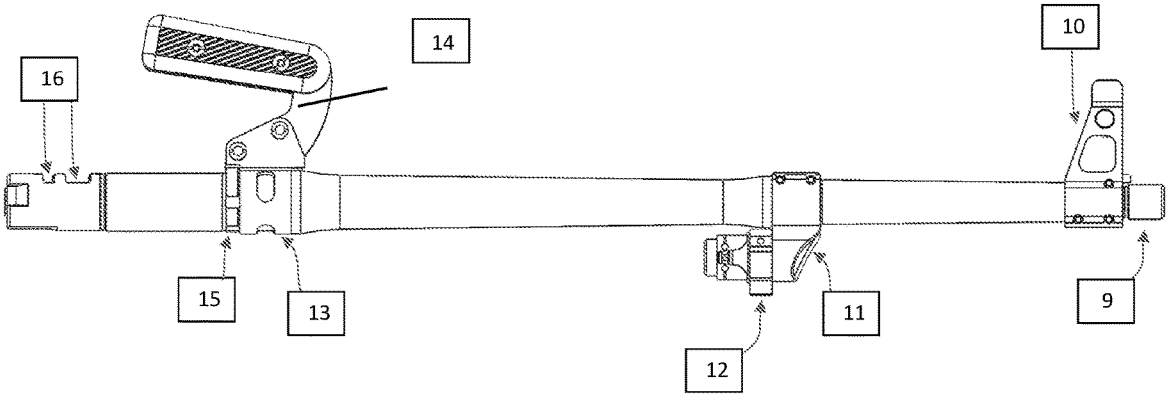
FIG. 3 shows the barrel.
Figure 4:
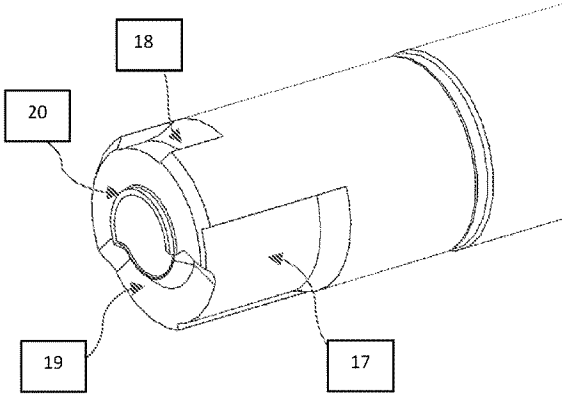
FIG. 4 depicts the barrel.

Infantry machine gun (FIG. 2) is composed of the following parts and mechanisms: a barrel; a receiver assembly comprising a cover and receiver base; lock frame with an extractor and gas piston; bolt; return mainspring with guiding bar; gas piston tube (with a leg); trigger mechanism. The barrel (FIG. 3, FIG. 4) of the proposed technical solution is intended for guiding bullet. It has an internal bore with four riflings winded from the left in upward direction to the right.

The riflings are intended to set a bullet in rotational motion. The gaps between the riflings are called as lands. A distance between two opposite lands (over a diameter) is called as a bore diameter; the infantry machine gun bore diameter is 7.62 mm. The bore is smooth in the breech end of the barrel and shaped as a case; this part of the bore is intended for receiving a cartridge and called as cartridge chamber. A transition from a cartridge chamber to a shot travel is called as a free bore.

The barrel externally has thread (9) on the chase for screwing the flash absorber (8) or barrel collar upon shooting by the blank cartridges; front sight base (10); gas chamber (11); charger with a machine gun handle (13, 14); projections for abutting by the barrel on the receiver assembly (15); two transverse cut-outs for the barrel latch (16). The handle projection moves the slide. In order to mount the slide in the required cut-out of the barrel projection, it is previously necessary to detach the handle from the charger. There are two grooves on the barrel projection for the receiver assembly projections and three cut-outs for fixing the handle in the backside position, the said receiver assembly projections limiting barrel swing. There is an opening in the barrel wall for withdrawing gases from the barrel bore into the gas chamber.

The breech end of the barrel has annular projection (20) for abutting by a cartridge case flange; cut-out for the extractor hook (19); in the bottom, a recess for passing by the step of the lock frame; on the right side, a recess for the receiver assembly.

Figure 5:
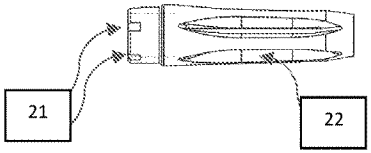
FIG. 5 depicts the flash absorber.

A flash absorber (FIG. 5) is intended for reducing flare-up upon shooting. It has left-hand thread for screwing on the machine gun barrel and five recesses for retainer. It has five longitudinal slits (22) for escaping gases and for cleaving a jet of flame, such flash absorbers being also called as slit flash absorbers. It is allowed to insert a screwdriver in these slits for screwing a flash absorber in/on the barrel in case of tough (complicated) rotation.

Figure 6:
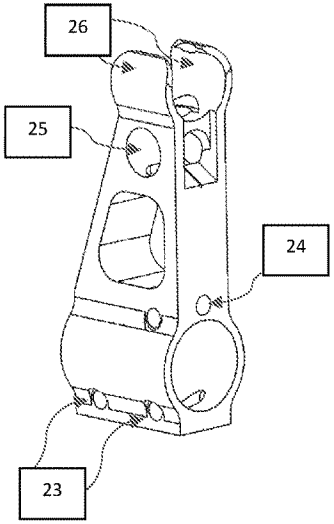
FIG. 6 represents front sight base.

The front-sight base (FIG. 6) is fastened on the barrel by two pins (23). It has an opening for the front-sight slide (25), front-sight cover (26). There is also an opening for a retainer with a spring preventing to remove the flash absorber and barrel collar for shooting by blank cartridges from the barrel.

Figure 7:
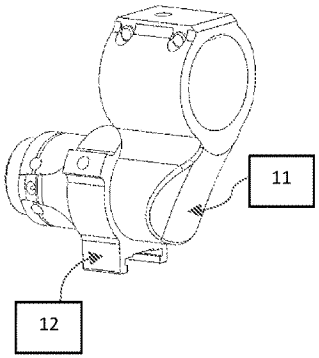
FIG. 7 shows gas chamber with gas adjuster.

A gas chamber (FIG. 7, ref 11) is intended for directing explosive gases withdrawn from the barrel bore to the gas piston of the lock frame and for positioning the adjuster. It is fixed on the barrel by two pins. The gas chamber has an internal orifice for passing by the gases (it is aligned with the gas withdrawal opening in the barrel wall), a branch piece having a channel for the gas piston and two apertures for discharging the gases in the lower part. The branch piece has an annular groove for putting the front end of the gas piston tube on and three recesses for receiving the adjuster projection fasteners on each side; the recesses are indicated by numerals 1, 2, 3.

Gas adjuster (FIG. 7, ref 12) is intended for adjusting an amount of the explosive gases acting on the lock frame piston. It has two apertures (elongated and circular) for discharging the gases out from the gas chamber, two projections provided with the fasteners for retaining the adjuster on the branch piece, housings for receiving a case flange used for rotating the adjuster upon setting the latter from one graduation to another.

After 3000 shots have been made, the machine gun continues to shoot with adjuster set to graduation 1. For the new machine guns (up to 3000 shots) and in case of incomplete lock frame retraction, the adjuster is set to graduation 2. The adjuster is set to graduation 3 when a shooting is carried out in the severe operation conditions and there are delays in it, the said delays being related with that the moving parts have not reached the end backward position (at the low air temperatures, when raining, when the machine gun is heavily dusted, etc.)

The machine gun handle (FIG. 10) is intended for replacing a barrel and transferring the machine gun in comfortable manner. The handle base (52) is pivotally connected to the charger (13). There is a slide (54) in the charger by means of which an initial movement of the barrel is provided in case of removing the barrel from the machine gun. By adjusting the slide in any one of the cut-outs on the barrel projection, the barrel handle can be fixed in the required position (for this purpose, it is necessary to detach the screw from the charger).

The receiver assembly (FIG. 8, FIG. 9) is intended for connecting the parts and mechanisms of the machine gun with each other, for guiding the lock frame with bolt and for closing the barrel bore by the bolt, and for latching the bolt; it is closed by the cover on its top side.

The receiver assembly has:-in its interior, the cylindrical conduit (39) for placing the breech end of the barrel; conduit of a rectangle cross-section with longitudinal recesses on the side walls for the gas piston tube; service abutments; bevelled projection for initial rotation of the bolt upon latching; folds, guiding bars and projections for guiding the lock frame and bolt; repulsing projection for repulsing the cases; housing for receiving the trigger mechanisms; housing for receiving guiding rod of the return mainspring. The folds of the receiver assembly have the cut-outs in its interior and on the rear side for passing by the lock frame and bolt when the machine gun is disassembled and assembled;

at the front side, cut-out for receiving the spring lock of the gas piston tube; two projections for limiting a circular swing of the barrel; trunnions and projections for mounting the machine gun on the carriage.

on the back side, two tangs having openings for fastening the butt and transverse recess with a depression for receiving the receiver assembly cover lock;

on the top side, tab for fastening a receiver assembly cover and receiver base; transverse groove for the barrel latch; inclined transverse cut-out for receiving the follower pawl; transverse cut-out for passing by a cartridge when the latter is rammed into the cartridge chamber; longitudinal window for passing by the lock frame leg;

on the left side, window for ejecting a case (cartridges) and shield;

on the right side, tab for fixing the follower and its shield; transverse groove for receiving the reloading handle;

on the bottom, a circular opening for draining water; trigger container with a pistol grip;

bracket for fastening a trigger container.

Figure 11:
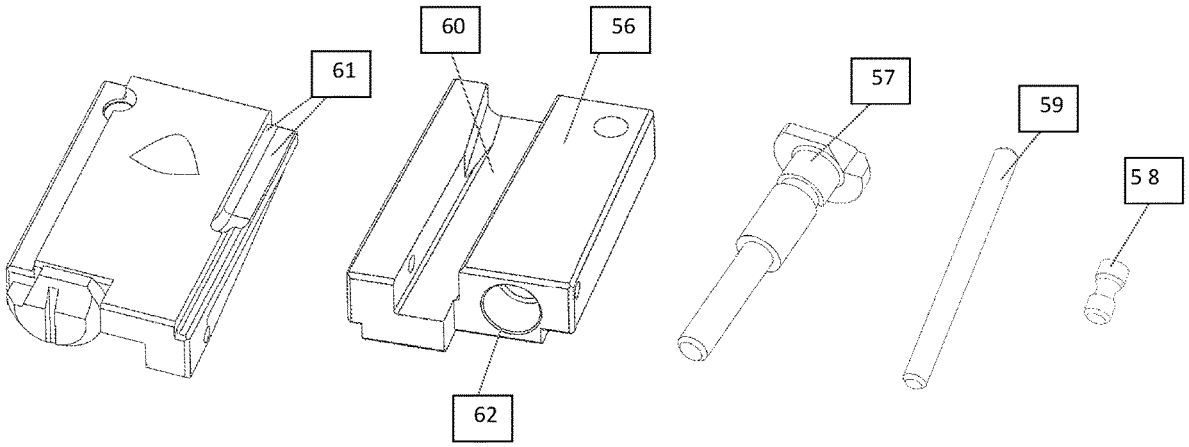
FIG. 11 shows the barrel latch.

The barrel latch (FIG. 11) is intended for fastening the barrel in the receiver assembly and for adjusting a gap between the bolt and back barrel cut. It is composed of the base, a screw, the base pin and stud of the screw.

The latch base has a recess for engaging the barrel in the lower part, stepped cut-out for passing by the follower pawl in the top part, the threaded conduit for the screw in the interior. The base pin keeps the barrel latch in the transverse recess of the receiver assembly.

The latch screw has a head with a slit for receiving a screwdriver. The stud of the screw is intended for preventing the screw from spontaneous rotation when the barrel latch is shifted to the left.

The barrel latch is retained by the lower end of the receiver assembly cover spring for preventing spontaneous shifting thereof to the left when the receiver base is lifted.

Figure 12:
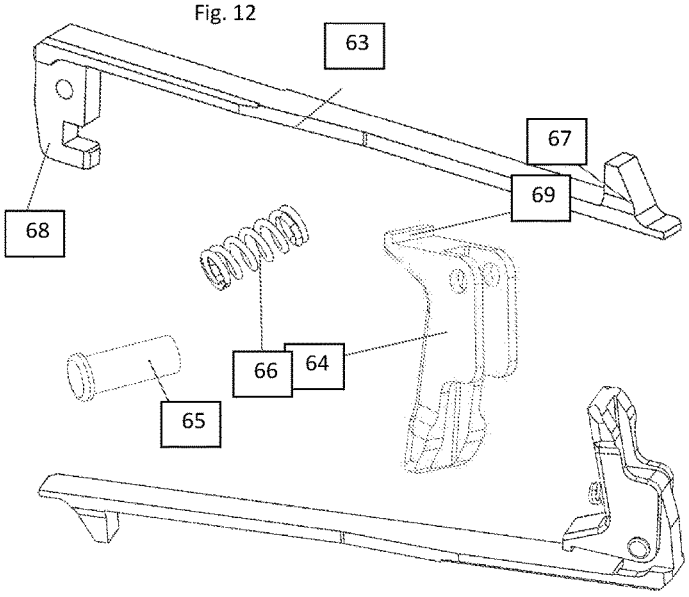
FIG. 12 depicts the reloading handle.

The reloading handle (FIG. 12) serves for retracting the lock frame. It consists of a rod and an arm equipped with a spring and axle.

The handle rod is housed in the longitudinal groove of the receiver assembly; it has the driving projection on its front end for engaging with the lock frame when the latter is retracted and the leg for fastening the arm on its rear side. The arm has the hook and spring for keeping the reloading handle in the advanced position.

Figure 13:
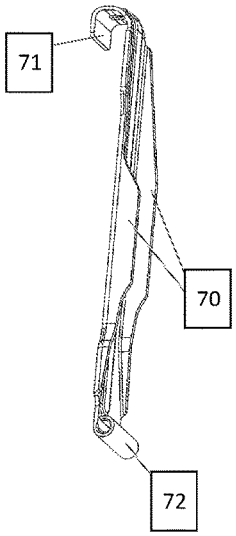
FIG. 13 shows the breech cover pusher.

The breech cover pusher (FIG. 13) is connected to the loop by the clamp and to the left wall of the receiver assembly by the fold, and is intended for opening the breech cover when the lock frame is retracted. It has the bevelled ribs for interacting with the lock frame and, on its front end, the fold for opening the breech cover.

Figure 25:
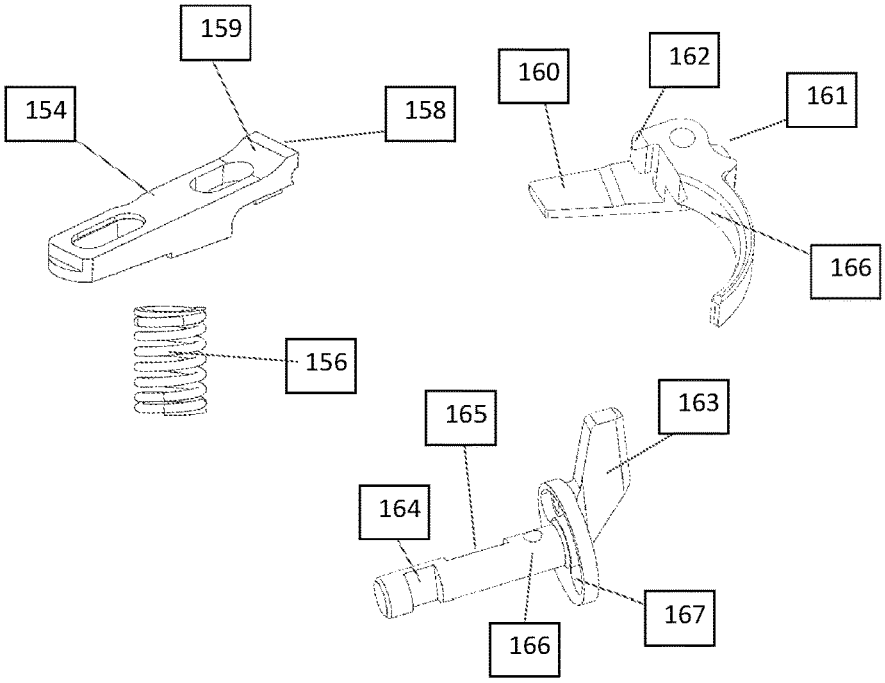
FIG. 25 depicts trigger mechanism.

The trigger mechanism (FIG. 25) is intended for keeping the lock frame in the cocked position, for releasing it from the cocked position and locking the machine gun. It is assembled in the trigger container and consists of the firing lever equipped with a spring, the trigger pull equipped with an axle, safety-lock and safety-lock catch equipped with a spring.

There is a cut-out and two projections in the front end of the machine gun trigger container for fastening the machine gun to the carriage.

The firing lever has the hammer catch keeping the lock frame in the cocked position.

The trigger pull is intended for releasing the hammer catch from cocked position of the lock frame. It has the hook for interacting with the firing lever, the branch piece that does not allow the lock frame to be completely retracted, if the machine gun is locked; the projection for limiting a trigger pull rotation and tang.

The safety-lock is intended for latching the firing lever when the lock frame is in the cocked position preventing from an accident shot to be fired. The safety-lock has the thumb piece, the narrow cut-out for receiving the trigger pull projection, the wide cut-out for passing by the firing lever, projection for fastening the safety-lock in the receiver assembly and two apertures for retainer.

Figure 26:
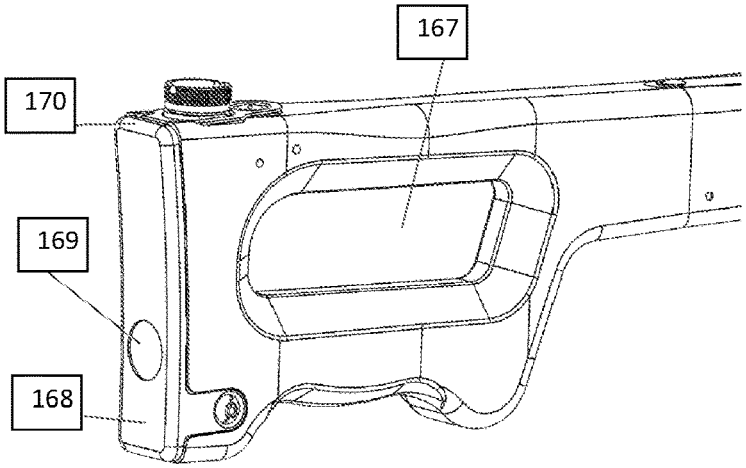
FIG. 26 shows the butt.

The butt (FIG. 26, FIG. 27) is intended for making the use of the machine gun more comfortable. It has the through opening for reducing own weight, the lubricator with a cover, the brush, the housing and the spring for the kit, the metal back plate with a cover for closing the butt housing.

Figure 14:
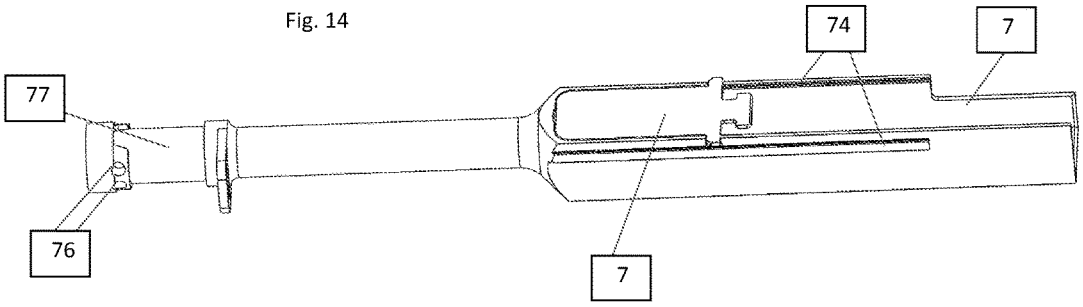
FIG. 14 depicts gas piston tube.

The gas piston tube (FIG. 14) is intended for guiding the lock frame with gas piston and for fastening the bipod.

The gas piston tube has the cut-out for passing by the reloading handle rod, guiding projections and the spring lock for connecting to the receiver assembly, the annular groove with cut-out for fastening the bipod base, four openings for discharging the explosive gases, the annular groove for the branch piece of the gas chamber.

Figure 15:
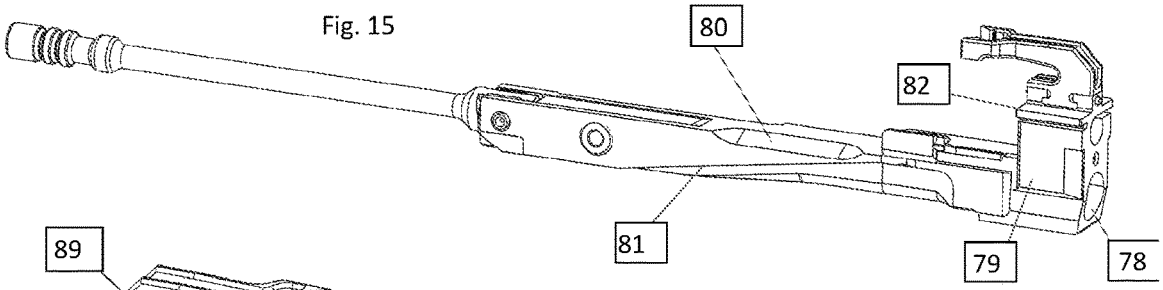
FIG. 15 shows the lock frame with gas piston.

The lock frame with gas piston (FIG. 15, FIG. 16) is intended for actuating the bolt and the follower and for extracting a cartridge from the belt.

The lock frame has the conduit for receiving the return mainspring in the interior of the lock frame, the figured cut-out for the driving bolt projection and the cut for passing by the ejected cases (cartridges) in the top part of the lock frame; the slanted edge for interacting with the follower roller and the projection for interacting with the breech cover pusher on the left side of the lock frame; the slanted edge with housing for interacting with the follower projection and the step for the reloading handle projection on the right side of the lock frame, the full cock on the bottom side of the lock frame; the housing for connecting to the gas piston on the front side of the lock frame.

The hooked extractor is secured to the leg by the stud on the rear side of the lock frame. There is the through opening in the stud for placing the bolt; the conduit has the annular groove for the firing hammer projection; there are the longitudinal grooves for moving the lock frame over the receiver assembly folds on the lateral sides; the right groove is further intended for passing by the repulsing projection of the receiver assembly.

The gas piston is intended for actuating the lock frame upon shooting. On its rear end, it has a bulge for connecting to the lock frame; on its front end, it has the annular grooves for improving a gas obturation in the branch piece of the gas chamber and the driving band for guiding the piston in the gas piston tube.

Figure 17:
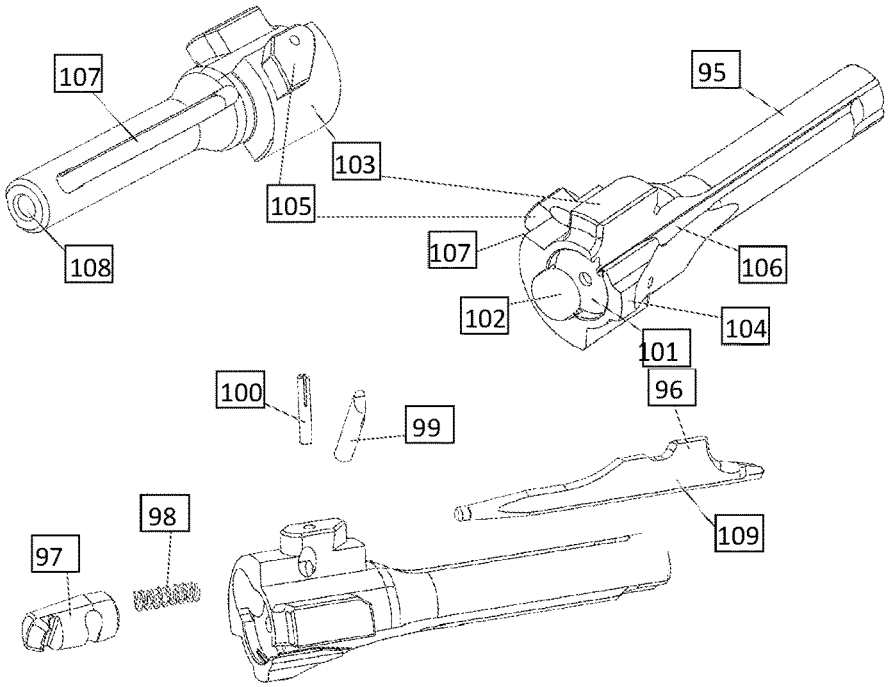
FIG. 17 represents the bolt.

The bolt (FIG. 17) is intended for ramming a cartridge into the cartridge chamber, for latching the barrel bore, for breaking a primer and for extracting a case (cartridge) from the cartridge chamber. It consists of the skeleton, the firing hammer, the extractor comprising a spring and an axle, and the stud.

On its front cut, the butt skeleton has two cylindrical cut-outs for a case bottom and for the extractor with a spring; on its both sides, it has two service projections which move behind the service abutments of the receiver assembly upon latching of the lock; on its top side, it has a projection (feed piece) for ramming a cartridge into the cartridge chamber; on its bottom side, it has the driving projection for connecting the bolt to the lock frame and for rotating the bolt upon latching and unlatching thereof; on its right side, it has the transverse housing for passing by the repulsing projection of the receiver assembly (this housing is widened on its end for rotating the bolt upon latching thereof); on its widened part, it has the opening for receiving the extractor axle and stud; in its interior, the butt skeleton has a conduit for placing the hammer.

The hammer has the striking pin, the projection for interacting with the lock frame and tang.

The extractor with a spring is intended for extracting a case (cartridge) from the cartridge chamber and for keeping it on the bolt until encountering with the repulsing projection of the receiver assembly. The extractor has the hook for catching a case flange, the housing for a spring and the cut-out for receiving the axle.

The stud is provided for fixing the extractor axle.

Figure 18:
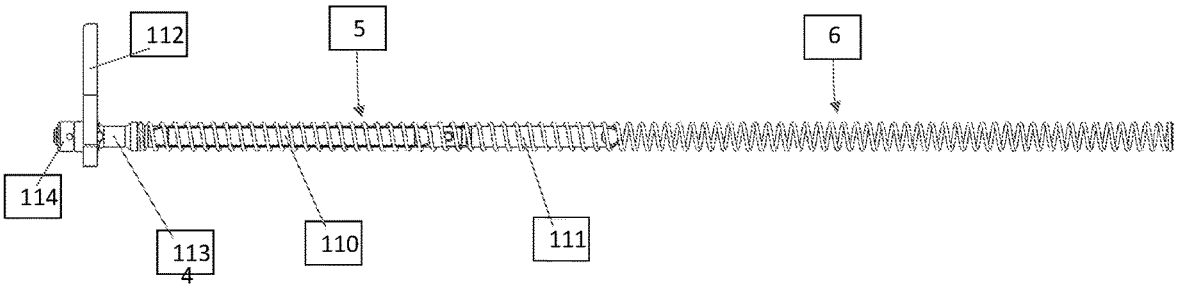
FIG. 18 depicts return mainspring with guiding bar.

The return mainspring (FIG. 18) is provided for rotating the lock frame with bolt into the advanced position and for transmitting the energy required for breaking a cartridge primer to the hammer.

The guiding rod consists of two parts pivotally connected with each other by means of the pin. The back side of the rod is connected to the lock frame arrester and has the steady bush with a retainer for the abutment of the return mainspring.

The lock frame arrester perceives the strikes of the lock frame in the extreme back position. It has the projection for connecting to the rear wall of the receiver assembly.

Figure 19:
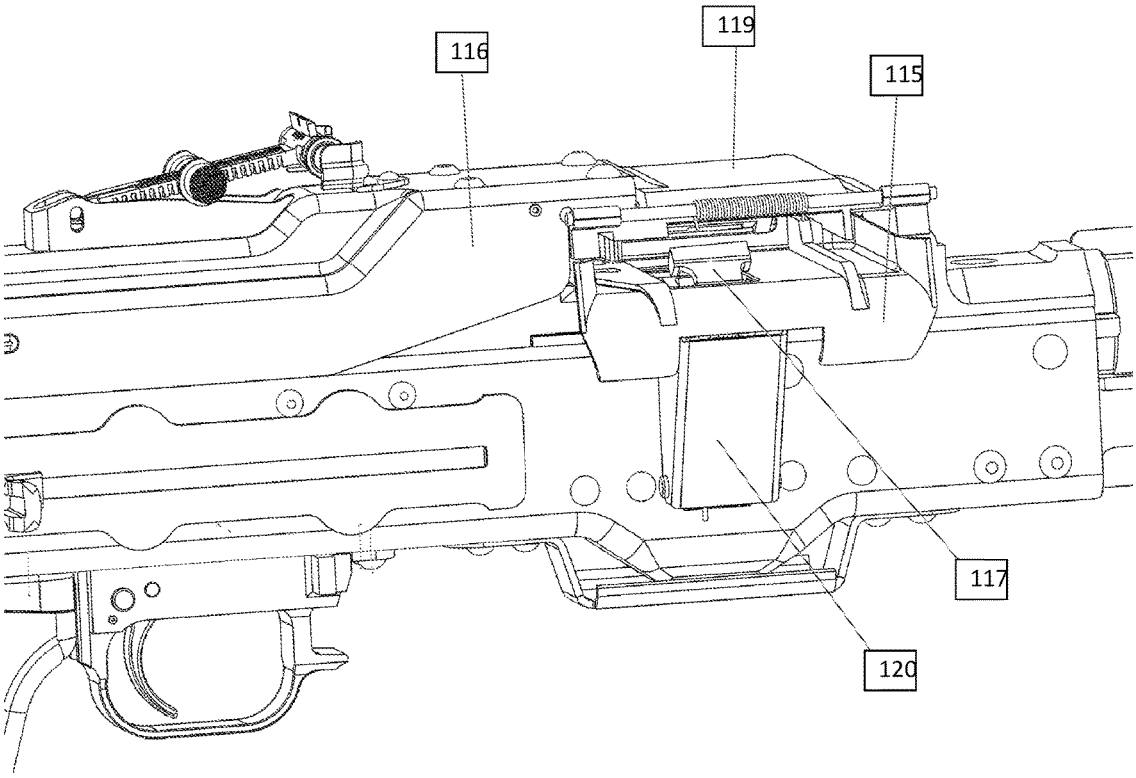
FIG. 19 depicts receiver.
Figure 20:
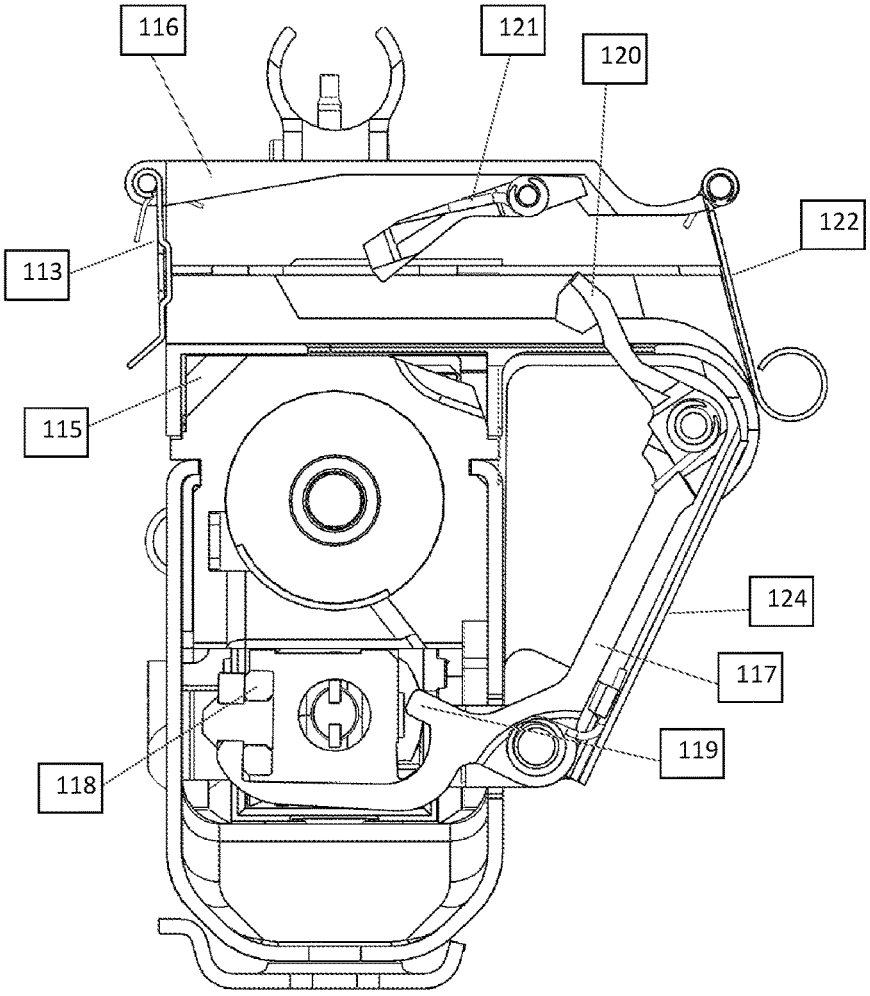
FIG. 20 depicts receiver.

The receiver (FIG. 19, FIG. 20) is intended for moving the cartridge feed belt and for feeding the cartridges from the belt to the receiving window of the receiver base upon shooting. The receiver consists of the base, the receiver assembly cover and the follower.

Figure 21:
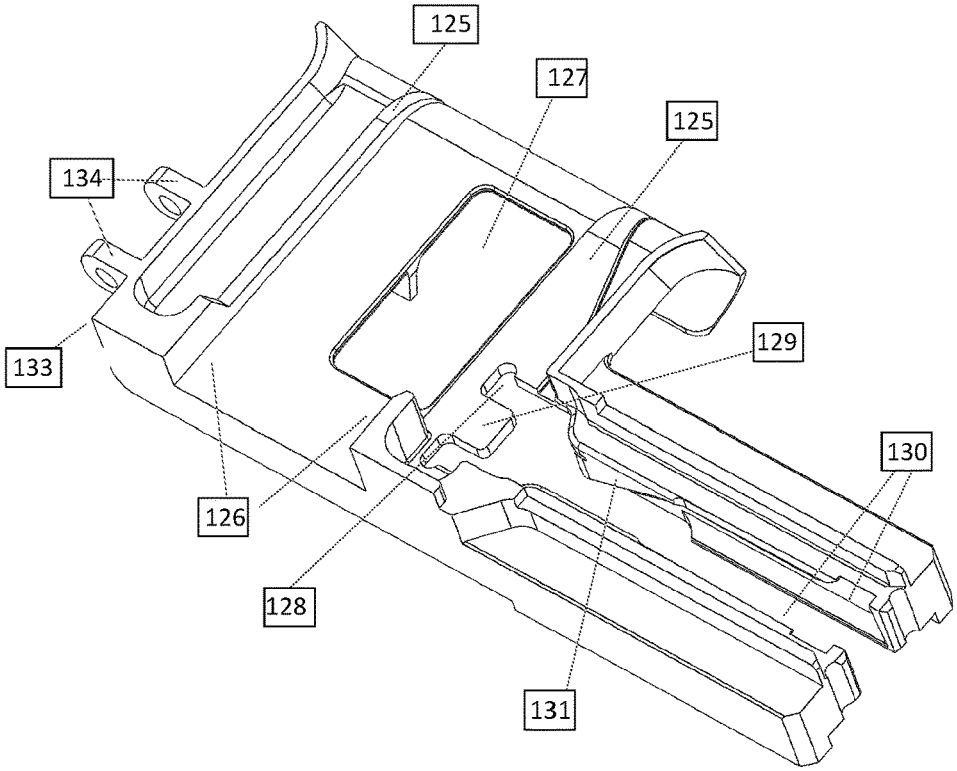
FIG. 21 depicts receiver base.

The receiver base (FIG. 21) serves for guiding the cartridge feed belt and for guiding a cartridge when the latter is rammed to the cartridge chamber. It has the guiding and limiting projections allowing a correct feeding of the next cartridge for catching the latter by the hooks of the extractor; the transverse window for the follower pawl; the figured cut-outs for passing by the extractor hooks; the projection for abutting by a case flange when a cartridge is caught by the extractor hooks; the receiving window having the cut-outs for passing by a case flange and slanted projections for guiding a cartridge when the latter is rammed to the cartridge chamber.

On its front side, the receiver base has tabs for mounting thereof in the receiver assembly and a retainer with a spring for retaining the receiver base in the closed and opened positions.

The receiver assembly cover (FIG. 22) serves for closing the receiver and receiver assembly. It has the guiding projections, which, when combined with the guiding projections of the receiver base, allow the correct feeding of the next cartridge for catching thereof by the extractor hooks; the top levers with a spring for retaining the cartridge feed belt in the receiver; the feeding lever with a spring and feeding comb for lowering a cartridge into the receiving window of the receiver base; two shields with springs for closing the receiver; lock with a spring.

There are the gunsight and the sight protector as well as the machine gun serial number on the top side of the receiver assembly cover.

The follower (FIG. 23) serves for feeding the cartridge feed belt into the receiver of the machine gun. The follower comprising a rod and a rod spring is connected by the axle in the receiver assembly tab on the right side. The follower has a roller and projection for interacting with the slanted edges of the lock frame. The pawl with a spring is attached to the top side of the follower.

Figure 24:
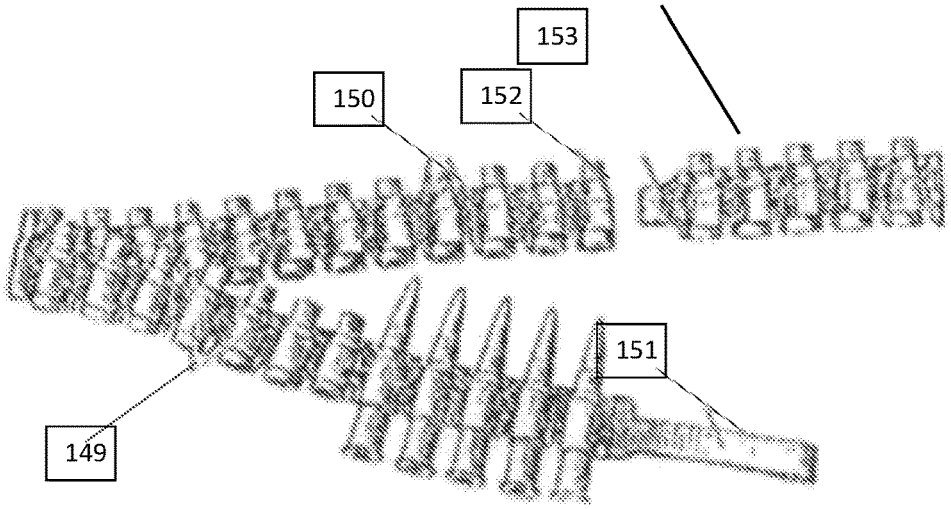
FIG. 24 shows cartridge feed belt.

The cartridge feed belt (FIG. 24) serves for receiving the cartridges and for feeding them in the machine gun receiver. The belt is composed of chains connected with each other by the connecting springs. There are the tips on the ends of the belt for comfortable loading of the machine gun.

The trigger mechanism (FIG. 25) is intended for retaining the lock frame in the cocked position, for releasing the lock frame from the cocked position and for locking the machine gun. The trigger mechanism is assembled in the trigger container and consists of the firing lever with a spring, trigger pull with an axle, safety-lock and safety-lock retainer with a spring.

There are the cut-out and two projections on the front side of the trigger container for mounting the machine gun on the carriage.

The firing lever has the hammer catch retaining the lock frame in the cocked position.

The trigger pull is intended for releasing the hammer catch from the cocked position of the lock frame. The trigger pull has the hook for interacting with the firing lever, the branch piece preventing the lock frame to be completely retracted, if the machine gun is locked, the projection for limiting a rotation of the trigger pull, and tang.

The safety-lock is intended for latching the firing lever when the lock frame is in the cocked position, preventing from an accident shot to be fired. The safety-lock has the thumb piece, the narrow cut-out for receiving the trigger pull projection, the wide cut-out for passing by the firing lever, the projection for fastening the safety-lock in the receiver assembly and two openings for retainer.

The butt (FIG. 26, FIG. 27) is intended for making the use of the machine gun more comfortable. It has the through opening for reducing its weight, the lubricator with the cover and the brush, the housing and the spring for the kit, the metal back plate with a cover for closing the butt housing.

The belt is intended for receiving the cartridges and feeding them in the machine gun receiver. The belt consists of chains connected with each other by the connecting springs. There are the tips on the end of the belt for comfortable loading of the machine gun.

Figure 16:
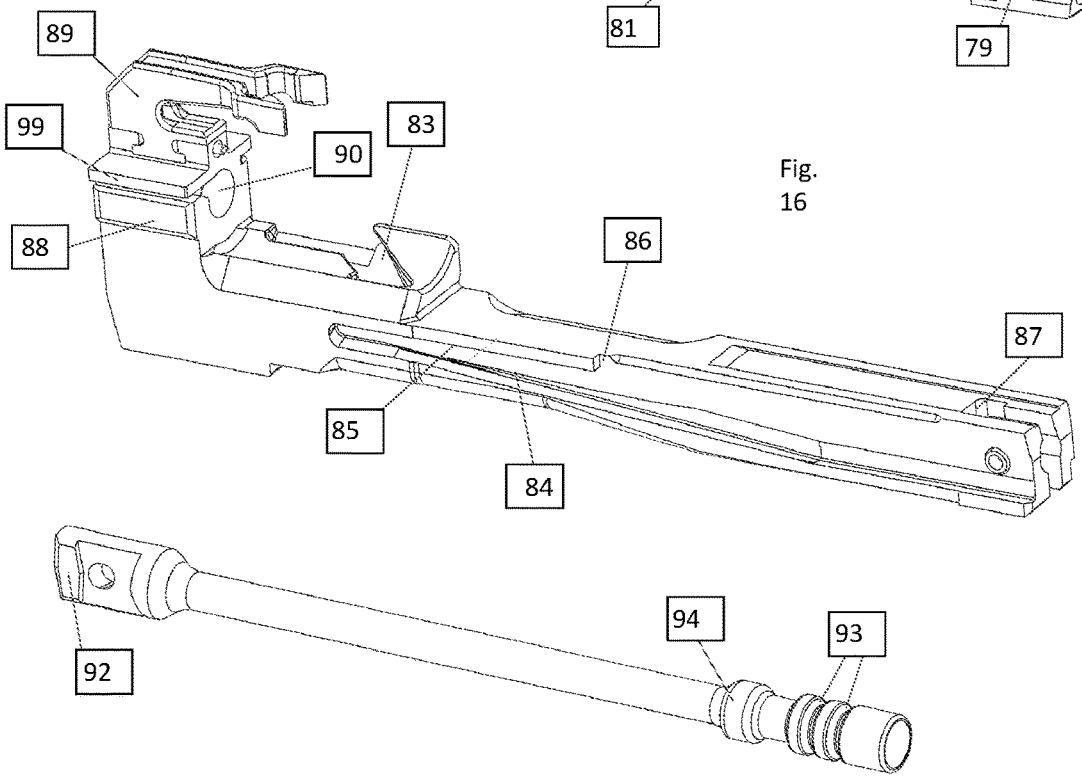
FIG. 16 shows the lock frame with gas piston.

FIG. 16 shows the positions of the parts and mechanisms, where ref. 1 indicates the bolt; ref 2 indicates the lock frame; ref. 3 indicates the feed lever; ref 4 indicates the hammer catch; ref 5 indicates the cartridge chamber.

The present technical solution operates as follows.

The machine gun automatically operates based on the principle of using the energy of the explosive gases being discharged from the barrel bore to the gas piston of the lock frame.

When shooting, a part of the explosive gases acting on a bullet is directed through the transverse gas-escape opening in the barrel wall to the gas chamber, this part of the gases pressing the front wall of the gas piston and repulsing the piston together with the lock frame into the rearward position. When the lock frame is retracted, the bolt is unlatched, a case is extracted from the cartridge chamber and ejected out from the receiver assembly, the next cartridge is extracted from the cartridge feed belt and fed into the longitudinal window of the receiver, the belt is moved within the receiver to the left by one chain and the return mainspring is compressed.

The bolt is unlatched by rotating it under the action of the lock frame around the longitudinal axis to the left as a result of which the service projections of the bolt are released from the service abutments of the receiver assembly. The lock frame strikes the arrester in its extreme rearward position and starts to move forward under the action of the return mainspring. If the firing lever is pressed, then the lock frame with bolt continues to move forward without delay caused by the hammer catch, the bolt feed piece ejects a cartridge from the transverse window of the receiver and rams it to the cartridge chamber, the extractor hooks catch the next cartridge in the belt and the pawl is moved to the right by one belt chain. When the lock frame reaches its extreme advanced position, the bolt is latched and a cartridge primer is broken by the striking pin. The bolt is latched by turning it around longitudinal axis to the right as a result of which the bolt service projections move behind the service abutments of the receiver assembly. The hammer is moved forward under the action of the annular groove of the lock frame and strikes a cartridge primer by the striking pin. A shot occurs and the operation of the machine gun automation is repeated.

If the firing lever is not pressed after a shot has been fired, then the lock frame with the bolt is stopped in the rearward position in full cock; in order to continue shooting, it is necessary to press again the firing lever. A shooting will be continued until the firing lever will be released or until all cartridges will be used in the belt.

The infantry machine gun proposed by the present utility model is operated as follows.

Positions of the Parts and Mechanisms Before Loading

The lock frame with gas piston and the bolt are in the extreme forward position under the action of the return mainspring; the gas piston is in the branch piece of the gas chamber; the barrel bore is latched by the bolt. The bolt has been turned around the longitudinal axis to the right so that its service projections have moved behind the service abutments of the receiver assembly (the bolt is latched); the hammer is in the forward position, the striking pin of the latter moves from the bore into the breechblock. The return mainspring is minimum compressed. The reloading handle is in the extreme forward position.

The follower occupies the extreme right position by entering with its projection into the housing on the right wall of the lock frame; the pawl has been lifted up by own spring; the upper levers and the actuator have been lowered down under the action of their springs in the receiver assembly cover.

The trigger pull has been lifted up, the finger piece has been drawn in the forward position; the safety-lock has been turned forward, the cut thereof has been turned upward and allows the firing lever to lower down.

The breech cover closes the receiver assembly window for ejecting the cases.

The receiver assembly cover has been closed; the receiver shields have been lowered down under the action of their springs.

Operation of the parts and mechanisms upon loading

In order to load the machine gun, it is necessary:

- to turn the machine gun handle to the left;
- to open the receiver assembly cover;
- to put the belt on the receiver base so that the first cartridge moves beyond the extractor hooks with its case bottom flange;
- to close the receiver assembly cover;
- to retract the lock frame behind the reloading handle until the lock frame is stopped and is in the cocked position;
- to draw the reloading handle forward until it is stopped.

The machine gun has been loaded. If an immediate shooting is not required, then the machine gun is to be locked by turning the thumb piece back, the wide cut-out occupies the lower position and the hammer catch can not be lowered down.

When retracting the reloading handle, the latter engages with the lock frame step by its driving projection and retracts the lock frame and compresses the return mainspring, the hammer retracts by occupying the annular groove of the lock frame leg with its projection.

The extractor hooks extract a cartridge from the belt and transfer it back; the cartridge lifts the actuator by compressing the spring of the latter; after a case bottom has reached the feeding comb, a cartridge is lowered down into the receiving window of the receiver base under the action of the feeding comb cut and of the actuator and arranges in front of the bolt feed piece.

After the lock frame has been drawn by the length of free play, the lock frame turns the bolt to the left by acting on the driving projection of the bolt by means of the front slant of the figured cut-out; the service projections of the bolt come out from the service abutments of the receiver assembly (the bolt is unlatched); the bolt retracts thereafter together with the lock frame.

When the handle is further retracted, the lock frame acts on the follower roller by the left slanted edge and on the shield pusher bevels by the projection. The follower top part is turned to the left; the pawl moves the belt to the left by abutting in the belt chain and arranges the next cartridge against the extractor hooks; the top levers of the receiver assembly cover retain the belt in the receiver together with the pawls by passing one cartridge to the left. The pusher is shifted to the left by the projection of the lock frame and opens the breech cover with its fold.

The hammer catch is lowered down under the action of the lock frame; as soon as the lock frame passes the hammer catch with its full cock, the hammer catch is lifted up under the action of the own spring; when retracting, the lock frame is set in the cocked position.

The lock frame projection releases the pusher by passing the pusher slants and the window of the receiver assembly is closed by the breech cover.

The machine gun has been loaded.

Operation of the parts and mechanisms of the proposed technical solution upon shooting In order to start shooting, it is necessary to turn the thumb piece forward, if the machine gun is locked, to press the firing lever by preliminary releasing its safety-lock.

The hammer catch is lowered down and releases the lock frame; the lock frame together with the bolt is pushed forward under the action of the return mainspring, the said lock ejects a cartridge from the receiving window of the receiver base by means of the feed piece, rams it to the cartridge chamber and latches the barrel bore.

When moving, the lock frame deflects the follower top part to the right by acting on the follower projection by means of its right slanted edge; the pawl springs behind the next belt chain; the top levers of the receiver assembly cover prevent the belt from falling out; when the bolt reaches the breech end of the barrel, the extractor enters in the cut-out of the breech end of the barrel and the extractor hook springs behind a case bottom flange. The bolt is rotated around the longitudinal axis to the right firstly under the action of the receiver assembly projection bevel on the right service projection bevel and then under the action of the back figured cut-out bevel of the lock frame on the driving projection; the service projections of the bolt move behind the receiver assembly service projections (the latching of the bolt occurs).

When the lock frame moves further, the extractor hooks spring behind a case bottom flange of the next cartridge; the hammer striking pin comes out from the opening in the breechblock and breaks a cartridge primer (a shot occurs).

A bullet is moved within the barrel bore under the pressure of the explosive gases; as soon as the bullet passes the gas-escape opening, a part of the explosive gases escape through this opening into the gas chamber, press the piston and throw the lock frame back. When moving back, the lock frame (as in case of drawing it behind the reloading handle) extracts a cartridge and transfer it back by means of the extractor hooks, the said cartridge being lowered down into the receiving window of the receiver base under the action of the feeding comb bevel and the actuator.

After the lock frame has passed the free play (10 to 15 mm), the lock frame rotates the bolt around the longitudinal axis to the left and releases the service projections of the bolt from the service abutments of the receiver assembly by acting on the driving bolt projection by means of its front bevel of the figured cut-out (the bolt is unlatched).

When the bolt moves back together with the lock frame, it extracts a case from the cartridge chamber by means of the extractor hook; the lock frame shifts the pusher to the left, the said pusher turning the breech cover and opening the window of the receiver assembly by means of its fold; a case that is retained by the extractor hook encounters the repulsing projection of the receiver assembly and is ejected out.

When moving back, the lock frame rotates the follower top part to the left by acting on the follower roller by means of its left slanted edge; the pawl moves the belt to the left and places the next cartridge against the extractor hooks.

After the lock frame has stroke the arrester in its extreme backward position, it is thrown forward under the action of the return mainspring and if the hammer catch is lowered down, then the lock frame is not stopped in the cocked position and rams the next cartridge into the cartridge chamber by means of the bolt and the hammer breaks a cartridge primer (the next shot occurs).

The automatic shooting is continued until the firing lever is pressed and there are the cartridges in the cartridge feed belt. When the firing lever is released, the lock frame is retained by the full cock in the rearward position (shooting is stopped), but the machine gun remains loaded. When all cartridges have been used and the trigger pull is pressed, the lock frame with the bolt remains in the extreme forward position.

The proposed infantry machine gun has the unique features that allow it to fire 30000 shots. The main advantage of the infantry machine gun that provides it with high competitiveness is high survivability of the barrel that allows to increase an operational functionality of the article.

What is claimed is:

1. A machine gun comprising a barrel, a receiver assembly having a cover, a receiver base and a butt;

a lock frame having an extractor and a gas piston;

a bolt, a return mainspring with guiding bar;

a gas piston tube;

a flash absorber;

a trigger mechanism;

a gunsight;

a butt sighting appliances;

a trigger pull and magazine, where: the barrel is made of steel preform produced of steel doped with chromium, molybdenum, vanadium, copper and manganese, the said steel containing (% by weight):

| carbon | silicon | manganese | nickel | chromium | copper |
|---|---|---|---|---|---|
| 0.4 | 0.21 | 0.88 | 0.19 | 0.96 | 0.32 |
| Molybdenum | sulphur | phosphorus | aluminium | tin | vanadium |
| 0.57 | 0.016 | 0.13 | 0.02 | 0.013 | 0.217 |

the barrel being coated inside, the steel comprising the additional chemical elements.

2. The machine gun of claim 1, characterised in that the barrel has a bore with four riflings that are winded from the left in upward direction to the right in its interior; the bore being smooth in the breech end of the barrel and shaped as case, and the breech end of the barrel comprising an annular projection for abutting by a cartridge case flange, a cut-out for receiving the extractor hook; in the lower part, a recess for passing by a lock frame step; on the right side, a recess for receiving the receiver assembly, wherein the barrel externally has:

a thread on the chase for screwing the flash absorber or bushing on upon shooting by a blank cartridges;

a flash absorber retainer base; a gas chamber;

a charger with the machine gun handle;

a projections for abutting by the barrel on the receiver assembly;

two transverse cut-outs for receiving a barrel latch;

a slide moving a handle projection;

on the barrel projection, there are grooves for the receiver assembly projections and the cut-outs for fixing the handle in the backward position;

the barrel wall has an opening for discharging gases from the barrel bore into the gas chamber; a chase comprising the annular projection for abutting by a cartridge case flange; the cut-out for the extractor hook; in the bottom part, a recess for passing by the lock frame step; on the right side, a recess for the receiver assembly.

* * * * *